United States Patent [19]

Takahashi et al.

[11] 4,312,386

[45] Jan. 26, 1982

[54] HARNESS FRAME FOR LOOMS

[75] Inventors: Kihei Takahashi; Seiko Terada, both of Uozu; Muchiji Shimono, Namerikawa, all of Japan

[73] Assignee: Yoshida Kogyo K. K., Tokyo, Japan

[21] Appl. No.: 90,996

[22] Filed: Nov. 5, 1979

[30] Foreign Application Priority Data

Nov. 20, 1978 [JP] Japan ..... 53-159749[U]

[51] Int. Cl.[3] ..... D03C 9/06

[52] U.S. Cl. ..... 139/92

[58] Field of Search ..... 139/91, 92, 82

[56] References Cited

U.S. PATENT DOCUMENTS

| | | | |
|---|---|---|---|
| 1,588,811 | 6/1926 | Russell | 139/92 |
| 2,776,675 | 1/1957 | Hochman | 139/91 X |
| 2,907,352 | 10/1959 | Kronoff | 139/91 X |
| 2,955,619 | 10/1960 | Flamand | 139/92 |
| 3,004,562 | 10/1961 | Kronoff | 139/91 |
| 3,169,555 | 2/1965 | Koyder et al. | 139/92 |
| 3,258,035 | 6/1966 | Fend | 139/92 |

*Primary Examiner*—Henry Jaudon

*Attorney, Agent, or Firm*—Hill, Van Santen, Steadman, Chiara & Simpson

[57] ABSTRACT

A harness frame for looms includes a pair of parallel spaced vertical planar side plates, and a pair of heddle-support bars extending perpendicularly from the vertical side plates. Each of the vertical side plates has an intermediate portion which, in horizontal cross section, extends at right angles to the general plane of the harness frame.

5 Claims, 5 Drawing Figures

HARNESS FRAME FOR LOOMS

BACKGROUND OF THE INVENTION

1. Field of the Invention

The present invention relates generally to a harness for looms, and more particularly to a harness frame for holding a plurality of heddles in position.

2. Prior Art

Apparatus for weaving a stringer tape of warp threads and a weft thread simultaneously with the weaving of a slide fastener coupling element, usually in the form of a helical coil, into the tape are known. Such apparatus generally include a loom for weaving the stringer tape of the warp and weft threads, and a coiling machine for supplying a monofilament to the weaving area alongside the warp threads and for coiling the monofilament in a conical orbital path around a mandrel to shape the monofilament into the fastener coupling element, which is then woven into the tape along a longitudinal edge thereof. In order to allow the coiled fastener coupling element to be mounted on the tape edge as stably as possible, it is essential to reduce the angular spacing between the innermost warp thread and the inner side of the conical orbital path of the monofilament to a minimum. However, conventional harness frames generally have a pair of vertical side plates disposed outside the warp threads and extending at right angles thereto, as viewed in horizontal cross section, and for this reason, the angular spacing between the innermost warp thread and the inner side of the monofilament's orbital path cannot be reduced sufficiently.

SUMMARY OF THE INVENTION

According to the present invention, a harness frame for looms includes a pair of parallel spaced vertical side plates, and a pair of heddle-support bars extending perpendicularly from the vertical side plates. Each of the vertical side plates has an intermediate portion which, in horizontal cross section, extends at right angles to the general plane of the harness frame. With this arrangement, it is possible to reduce the angular spacing between the innermost warp thread and the inner side of the conical orbital path of the monofilament to some extent, thereby enabling a slide fastener coupling element to be woven more stably into a stringer tape.

It is therefore an object of the present invention to provide an improved harness frame which is particularly advantageous when used in an apparatus for weaving a stringer tape simultaneously with the weaving of a slide fastener coupling element, usually in the form of a helical coil, into the tape.

Many other advantages, features and additional objects of the present invention will become manifest to those versed in the art upon making reference to the detailed description and the accompanying drawings in which a preferred structural embodiment incorporating the principles of the present invention is shown by way of example.

DETAILED DESCRIPTION OF THE PREFERRED EMBODIMENT

Figure 1:
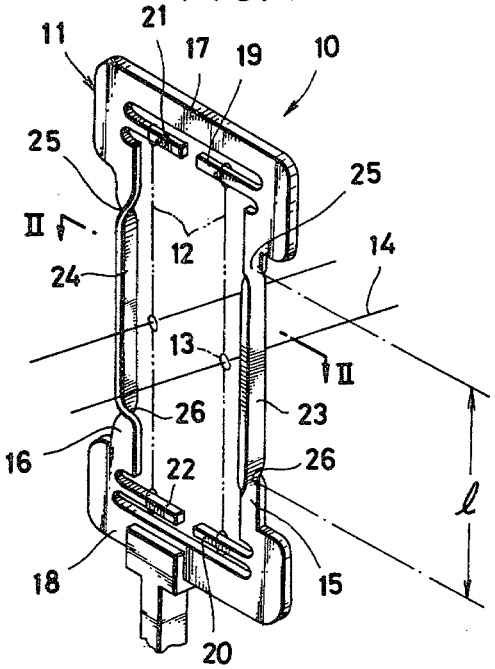
FIG. 1 is a perspective view of a harness frame constructed in accordance with the present invention.

As shown in FIG. 1, a harness 10 for looms comprises a centrally open frame 11 and a plurality of heddles 12 (only two heddles are shown here, diagramatically) carried thereon, each of the heddles 12 having an eyelet 13 in its center through which a warp thread 14 may pass in weaving. The harness frame 11 is generally rectangular and includes a pair of vertical side members or plates 15,16 and a pair of top and bottom members or plates 17,18 connected endwise to the vertical side members 15,16. The harness frame 11 further includes a first pair and a second pair of heddle-support bars 19,20 and 21,22, each pair spaced from the other pair and extending as cantilevers from the opposite vertical side members 15,16 toward each other. The heddles 12 are divided into two groups carried separately by the first and second pairs of bars 19,20 and 21,22.

Figure 2:
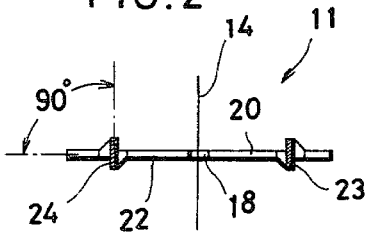
FIG. 2 is a cross-sectional view taken along line II—II of FIG. 1.

Each of the vertical side members 15,16 has a portion 23,24 which extends to cross the general plane of the frame 11 at right angles, as viewed in horizontal cross section (FIG. 2). The portion 23,24 of each vertical side member 15,16 is flat and extends longitudinally (vertically) through a predetermined range l, which is defined by a pair of upper and lower twisted points 25,26 (FIG. 1).

Figure 3:
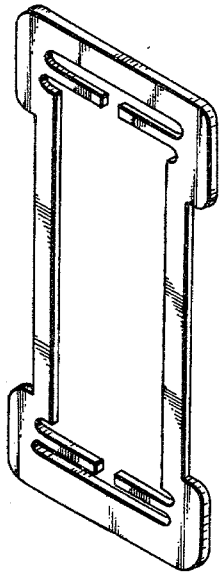
FIG. 3 is a perspective view of a half-finished harness frame, showing a pair of vertical side plates thereof before they have been twisted.

In production, a blank sheet of metal (not shown) is cut into the shape of FIG. 3. Then, each of the vertical side members 15,16 is twisted by 90° (FIG. 2) at the upper and lower points 25,26 so as to provide the portion 23,24 therebetween, thus obtaining the harness frame 11 of FIG. 1. Such twist makes the individual side member 15,16 of the harness frame 11 protective against objectionable resonant or induced vibration.

The harness frame 11 thus constructed is particularly advantageous when used in a needle loom 30 (FIG. 4) for weaving a stringer tape 31 of the warp threads 14 and a weft thread 32 simultaneously with the weaving of a slide fastener coupling element 33, usually in the form of a helical coil, into the tape 31. The needle loom 30 essentially includes a plurality of the harnesses 10 (only harness frames 11 of which are shown here) for forming sheds of the warp threads 14, a filling carrier 34 for inserting the weft thread 32 across the warp shed, a latch needle 35 for catching and knitting the weft thread 32 in the warp shed to form a selvedge along one longitudinal tape edge, and a reed 36 for beating the weft thread 32 in the warp shed into the fell 37 of the tape 31. The needle loom 30 further includes a coiling rotor assembly 38 for supplying a monofilament 39 and for coiling the same in a conical orbital path around a mandrel or coiling needle 40 to shape the monofilament 39 into the fastener coupling element 33 to be disposed along the other longitudinal tape edge remote from the selvedge. The coiling rotor assembly 38 is disposed alongside the warp threads 14, and the monofilament 39 at the inner side 41 of its conical orbital path is angularly spaced by an angle α from the innermost warp thread 14*a*. Most importantly, the portion 23,24 of each side frame member 15,16 extends parallel to the warp threads 14, as viewed in horizontal cross section. Accordingly, this harness frame 11 enables the inner side 41 of the monofilament's orbital path to be disposed more closely to the innermost warp thread 14*a*, thereby preventing the slide fastener coupling element 33 from being unstably mounted on the tape edge.

Figure 4:
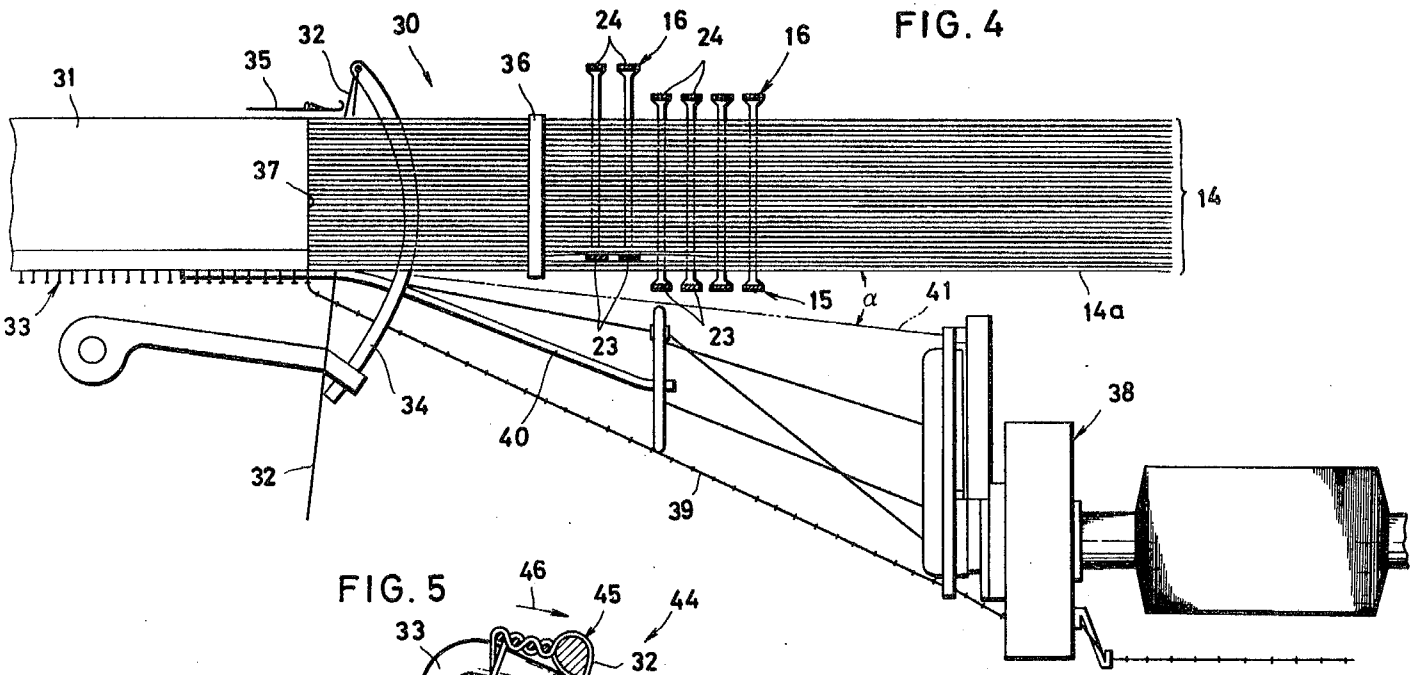
FIG. 4 is a schematic plan view of an apparatus for manufacturing a woven slide fastener stringer, with several harness frames of the invention shown in horizontal cross section.
Figure 5:
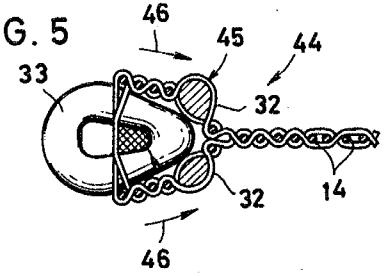
FIG. 5 is a fragmentary cross-sectional view of a slide fastener stringer manufactured with the apparatus of FIG. 4.

FIG. 5 shows a fragment of a slide fastener stringer 44 manufactured on the needle loom 30 of FIG. 4 utilizing the harness frames 11 according the invention. The slide fastener stringer 44 has a tubular structure 45, which holds the fastener coupling element 33 nicely so that the tubular structure 45 itself is kept from being displaced in the direction of the arrow 46.

Moreover, the harness frame 11 can be positioned so as to place one of the vertical side member 15,16 in between adjacent warp threads 14, as shown in FIG. 4.

Although various minor modifications may be suggested by those versed in the art, it should be understood that we wish to embody within the scope of the patent warranted thereon all such embodiments as reasonably and properly come within the scope of our contribution to the art.

What we claim is:

1. A unitary harness frame of sheet metal for looms employing warp threads, comprising:

(a) a pair of integrally joined parallel spaced vertical outermost side members, each having flat portions lying in a common plane; and (b) a pair of heddle-support bars extending perpendicularly as cantilevers in said plane from at least one of said vertical side members;

(c) at least one of said vertical side members having a further flat portion between said pair of heddle support bars which, in horizontal cross section, extends at a right angle to said plane, the thickness of said further portion being that of said first-named flat portions, whereby said one vertical side member may be disposed between warp threads in a loom.

2. A harness frame according to claim 1, said further flat portion of said one of said vertical outermost side members being an elongate plate so twisted that said further flat portion is at a right angle to the other portions of the same vertical side member.

3. A harness frame according to claim 1, said one of said vertical outermost side members at said further flat portion having twists at its upper and lower ends, said further portion being flat between said upper and lower twists.

4. A harness for looms, comprising:

(a) a centrally open unitary sheet-like frame lying, except as noted in (c), below, in a single plane and having (1) a pair of parallel spaced vertical outermost side plates, and (2) a first pair and and a second pair of heddle-support bars, each pair being spaced from the other pair and extending as cantilevers from and integral with said vertical side plates toward each other; and (b) a plurality of heddles, each carried on two of said heddle-support bars;

(c) each of said vertical outermost side plates having an intermediate flat portion lying in a single plane which, in horizontal cross section, extends at a right angle to said plane of said frame.

5. A unitary harness frame of sheet metal for looms employing warp threads, comprising:

(a) a pair of integrally joined parallel spaced vertical side members each having flat end portions lying in a common plane; and (b) a pair of heddle-support bars extending perpendicularly from each of said vertical side members;

(c) said vertical side members having a flat intermediate portion between said pairs of heddle-support bars lying in a single plane extending, in horizontal cross section, at a right angle to the general plane of said harness frame, said intermediate portion of said one of said vertical side members being an elongate flat plate twisted at opposite ends of said intermediate portion.

* * * * *